US005489747A

United States Patent [19]

Takenaka et al.

[11] Patent Number: 5,489,747

[45] Date of Patent: Feb. 6, 1996

[54] DEVELOPING DEVICE FOR AN IMAGE FORMING APPARATUS

[75] Inventors: Eiji Takenaka, Isehara; Kazuhiro Yuasa, Zama; Shuichi Endoh, Isehara; Iwao Matsumae, Tokyo; Yoshiaki Tanaka, Kawasaki; Hiroshi Hosokawa, Yokohama; Mugijiroh Uno, Isehara; Hiroshi Saitoh, Ayase; Toshihiro Sugiyama, Atsugi; Tetsuo Yamanaka, Tokyo; Eisaku Murakami, Hiratsuka; Satoru Komatsubara, Atsugi, all of Japan

[73] Assignee: Ricoh Company, Ltd., Tokyo, Japan

[21] Appl. No.: 430,473

[22] Filed: Apr. 28, 1995

[30] Foreign Application Priority Data

Apr. 28, 1994 [JP] Japan ..... 6-092346
Mar. 22, 1995 [JP] Japan ..... 7-062750

[51] Int. Cl.[6] ..... G03G 15/08

[52] U.S. Cl. ..... 118/653; 355/259

[58] Field of Search ..... 355/251, 253, 355/259; 118/653, 657, 658

[56] References Cited

U.S. PATENT DOCUMENTS

| | | | |
|---|---|---|---|
| 4,537,491 | 8/1985 | Komada et al. | 118/658 X |
| 5,126,799 | 6/1992 | Matsuura et al. | 355/298 |
| 5,212,521 | 5/1993 | Ogawa et al. | 118/653 X |
| 5,223,668 | 6/1993 | Takaya et al. | 355/259 X |
| 5,235,387 | 8/1993 | Sato et al. | 118/653 |
| 5,287,151 | 2/1994 | Sugiyama | 355/260 |
| 5,289,241 | 2/1994 | Sugiyama et al. | 355/260 |
| 5,315,357 | 5/1994 | Kamijo et al. | 355/298 |

FOREIGN PATENT DOCUMENTS

| | | |
|---|---|---|
| 60-229060 | 11/1985 | Japan . |
| 2-208672 | 8/1990 | Japan . |
| 5-333681 | 12/1993 | Japan . |
| 6-175477 | 6/1994 | Japan . |

*Primary Examiner*—Joan H. Pendegrass
*Assistant Examiner*—Quana Grainger
*Attorney, Agent, or Firm*—Oblon, Spivak, McClelland, Maier & Neustadt

[57] ABSTRACT

A developing device for an image forming apparatus and having a relatively hard first developing roller formed with fine N-S magnetic poles on the periphery thereof, and a relatively soft second developing roller for conveying toner electrostatically transferred thereto from the first roller toward a photoconductive drum. The toner is charged by friction while being passed through between the first roller and a blade, and then magnetically deposited on the first roller. At a position where the first and second rollers contact each other, only the adequately charged toner is electrostatically transferred from the first roller to the second roller. The second roller conveys the toner toward the drum. As a result, the toner is brought to a developing position in an amount corresponding to a saturation or maximum image density. The second roller is made up of a metallic conductive core, a semiconductive foam layer, and an insulative surface layer implemented by resin. The real resistance between the core and the surface is selected to be higher than $10^3$ Ω but lower than $10^{13}$ Ω. The ratio of the real resistance associated with the maximum temperature change to the real resistance at normal temperature is selected to be less than or equal to 4 in absolute value.

3 Claims, 8 Drawing Sheets

DEVELOPING DEVICE FOR AN IMAGE FORMING APPARATUS

BACKGROUND OF THE INVENTION

The present invention relates to a developing device for an image forming apparatus and having a relatively hard first developing roller formed with fine N-S magnetic poles on the periphery thereof, and a relatively soft second developing roller for conveying toner electrostatically transferred thereto from the first roller toward a photoconductive drum.

An electrophotographic system is customary with a copier, facsimile apparatus, printer or similar image forming apparatus. This kind of apparatus includes a photoconductive element or image carrier, and a developing device adjoining the element. A latent image is electrostatically formed on the photoconductive element. The developing device develops the latent image by depositing toner thereon in accordance with the potential distribution of the latent image. For the development, there are available two different systems, i.e., an S-NSP system using a relatively soft developing roller, and a μ-ISP system using a relatively hard developing roller. However, the problem with these conventional systems is that the toner is partly charged to polarity opposite to expected polarity. The oppositely charged toner forms black spots on the background of a recorded image and thereby lowers the image quality.

To obviated the problem attributable to the oppositely charged toner, use may be made of a magnetic first developing roller made of a hard material, and a second developing roller made of a soft material, as proposed in the past. Magnetic toner is magnetically deposited on the first roller, and then electrostatically transferred to the second roller which is so biased as to cause such toner transfer to occur. However, even such an improved scheme is apt to destroy the photoconductive layer of the drum, to bring about defective or unclear images, and to result in the need for an expensive high-tension power source and special equipment for insulation.

SUMMARY OF THE INVENTION

It is, therefore, an object of the present invention to provide a developing device for an forming apparatus and capable of freeing images from irregular density distributions and background contamination and thereby ensuring clear-cut images.

It is another object of the present invention to provide a developing device for an image forming apparatus and capable of preventing the photoconductive layer of a photoconductive drum from being destroyed.

It is a further object of the present invention to provide a developing device for an image forming apparatus and capable of eliminating the need for an expensive high-tension power source and equipment for insulation.

A developing device for developing a latent image electrostatically formed on an image carrier by toner of the present invention has a first developing roller made of a relatively hard material and formed with fine N-S magnetic poles on the periphery thereof. The first roller conveys the toner magnetically deposited thereon. A blade contacts the first developing roller and regulates the amount of toner being conveyed by the first developing roller, and charges the toner being passed through between it and the first developing roller by friction. A second developing roller is made of a material softer than the material of the first developing roller and held in contact with the first developing roller. The second roller causes the toner adequately charged to be electrostatically transferred thereto from the first developing roller and conveys it to the image carrier. A bias power source applies a particular bias voltage to each of the first and second developing rollers. The second developing roller has a real resistance of higher than $10^3$ Ω but lower than $10^{13}$ Ω between the bias application point and the surface portion thereof.

BRIEF DESCRIPTION OF THE DRAWINGS

The above and other objects, features and advantages of the present invention will become more apparent from the following detailed description taken with the accompanying drawings in which.

In the figure, the same or similar constituent parts are designated by the same reference numerals.

DESCRIPTION OF THE PREFERRED EMBODIMENT

Figure 13:
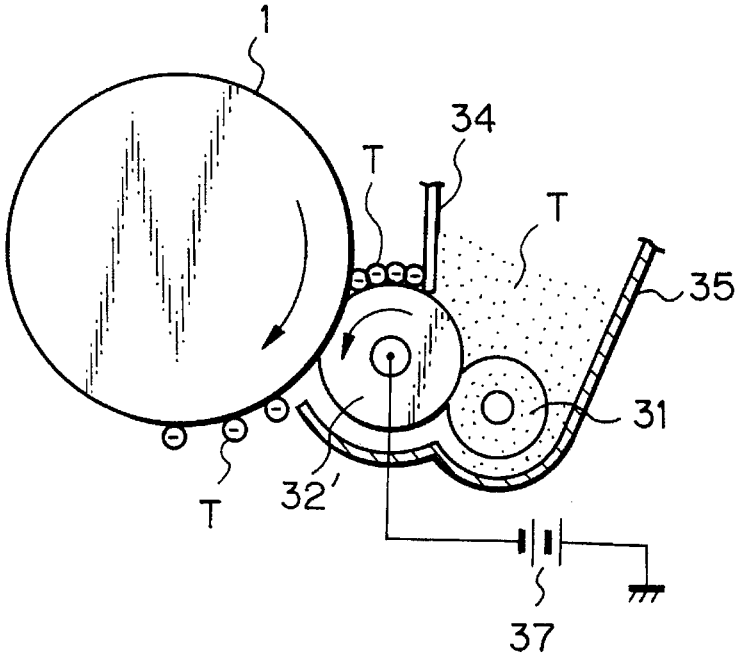
Fig. 13 PRIOR ART
FIG. 13 is a section of a conventional S-NSP type developing device.

To better understand the present invention, a brief reference will be made to a conventional S-NSP type developing device using a developing roller made of an elastic material, shown in FIG. 13. As shown, the device has a developing roller 32' pressed against a photoconductive drum 1 and a toner supply roller 31. In this condition, the roller 32' is elastically deformed to form a nip portion having a predetermined area between it and the drum 1 and between it and the roller 31. The roller 32' is frictionally charged while rotating in contact with the roller 31. Toner T is stored in a hopper 35. The roller 31 charges the toner T to negative polarity while conveying it from the hopper 35 to the roller 32'. As a result, the toner T is deposited on and conveyed by the roller 32' to which a negative high-tension bias is applied from a high-tension power source 37. A blade 34 regulates the toner T, being conveyed by the roller 32', to a predetermined thickness and thereby forms a thin toner layer on the roller 32'. The roller 32' conveys the thin toner layer to a developing position where it contacts the drum 1. The drum 1 carries an electrostatic latent image thereon. At the developing position, the toner F is transferred from the roller 32' to the drum 1 in an amount matching the potential of the latent image. The drum 1 conveys the toner T to transfer position where an image transfer unit, not shown, is located. As a result, the toner image is transferred from the drum 1 to a paper, not shown.

Figure 14:
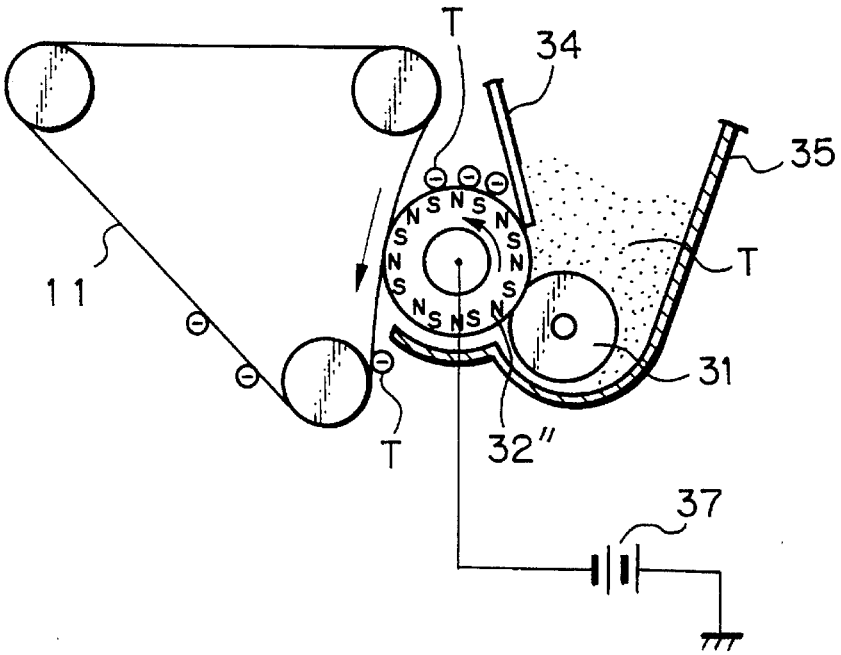
Fig. 14 PRIOR ART
FIG. 14 is a section of a conventional μ-ISP type developing device.

FIG. 14 shows a conventional μ-ISP type developing device using a developing roller made of a hard material. As shown, a developing roller 32" has fine N-S magnetic poles in a surface layer thereof. The toner T stored in the hopper 35 is magnetic toner. The toner T in conveyance is charged by the friction between it and the blade 34 and the friction between particles constituting it themselves. A flexible photoconductive belt, or image carrier, 11 contacts the hard developing roller 32" over a predetermined nip area. The toner T is deposited on the roller 32" and conveyed toward a developing position where the roller 32" contacts the belt 11. At the developing position, the toner T is transferred from the roller 32" to the belt 11 due to the electrostatic force of a latent image carried on the belt 11.

The S-NSP type device shown in FIG. 13 and the μ-ISP type device shown in FIG. 14 each has some problems yet to be solved, as follows. As for the S-NSP type device, the developing roller 32' is made of an elastic material, and therefore apt to suffer from permanent compression set (creep deformation) due to its contact with the blade 34 and drum 1. The deformed roller 32' cannot contact the blade 34 and drum 1 evenly, preventing the thin toner layer to be formed between it and the blade 34. As a result, the expected development of a latent image is obstructed. Moreover, because it is difficult to charge the toner T uniformly, the toner T is often charged to the opposite polarity which causes fine spots or similar smears to appear on the background of an image. The μ-ISP type device is free from the above problems because the developing roller 32" is made of a hard material. However, the soft belt 11, passed over rollers, results in the need for a space for accommodating the belt 11 and a space for accommodating a mechanism for driving it. This makes an image forming apparatus bulky, complicated, and expensive. Further, extra means is needed for preventing the belt 11 from becoming offset in the axial direction of the rollers due to, among others, the uneven tension distribution of the belt 11. In addition, even this type of device cannot avoid the charging of the toner T to the opposite polarity. Specifically, black spots appear on the background of an image, lowering the image quality.

To obviate the problems attributable to the oppositely charged toner, use may be made of a magnetic first developing roller made of a hard material, and a second developing roller made of a soft material, as proposed in the past. Magnetic toner is magnetically deposited on the first roller, and then electrostatically transferred to the second roller which is so biased as to cause such toner transfer to occur. The toner is conveyed by the second roller to a developing position. As a result, the toner charged to the opposite polarity is prevented from arriving at the developing roller.

Generally, in a developing device of the type using only toner, as distinguished frown a toner and carrier mixture, the toner is charged by friction when it is passed through between the first developing roller roller, and a blade. To ensure the uniform charging of toner, it is necessary that the amount of toner deposition on the roller for a unit area be limited. Should the roller convey more than the limited amount of toner, the amount of uncharged toner, toner of short charge and oppositely charged toner would increase. The above improved scheme, using the first and second developing rollers, can prevent uncharged toner and oppositely charged toner from arriving at the developing position, but it fails to do so when it comes to toner of short charge. A toner image derived from such toner of short charge fails to have a predetermined density or a predetermined gray scale ratio.

Assume that the amount of toner deposition on the first developing roller for a unit area is limited in order to obviate the degradation of an image while ensuring the uniform charging of the toner. Then, the amount of toner for a unit area which can be transferred to a photoconductive element for a unit time is also limited. As a result, it sometimes occurs that an image density as high as that of a document image is not achievable. In the light of this, it has been proposed to rotate the developing roller at a peripheral speed two to three times higher than the peripheral speed of the photoconductive element. This successfully increases the amount of toner for a unit area to be transferred from the developing roller to the photocondutive element.

Figure 7:
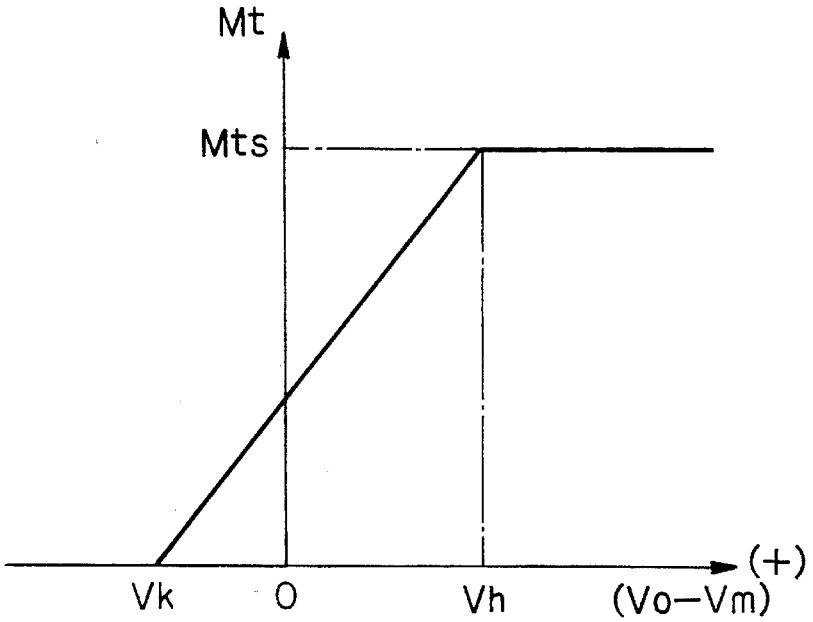
FIG. 7 shows a general development gamma characteristic.

When the surface potential of the second developing roller decreases (changes to the positive side), the amount of toner for a unit area to be transferred from the roller to the photoconductive element also decreases. Assume that the photoconductive element has an electrostatic potential Vo, that the second developing roller has a surface potential Vm, and that the amount of toner to deposit on the photoconductive element for a unit time and a unit area is Mt. FIG. 7 shows a relation between the difference between the potentials Vo and Vm, i.e., Vo–Vm and the amount of toner deposition Mt, i.e., a development gamma characteristic. There are also shown in FIG. 7 a limit voltage Vk which is the minimum voltage enabling development, a saturation voltage Vh which is the maximum voltage allowing the amount of toner deposition for a unit time and a unit area Mt $g/(cm^2.t)$ to increase, and the amount of toner deposition Mts caused by the saturation voltage Vh. These values are inherent in each developing device. As FIG. 7 indicates, a certain amount of toner deposits on the photoconductive element in the range of $Vk<(Vo-Vm)<0$. This is because, when Vo and Vm lie in the above range, mechanical (molecular) adhesion is predominant over electrostatic repulsion acting on the toner.

The surface potential Vm of the second roller depends on the bias applied thereto and the resistance of the material constituting it. When the second roller is made of a perfect conductor, the potential Vm is identical with the bias applied thereto. A photoconductive drum, which is a specific form of a photoconductive element, is made up of a drum-like conductor connected to ground, a semiconductive photoconductive layer formed on the conductor later. The problem with the drum is that the insulating layer is an extremely thin film and cannot avoid fine defects. When the drum is held in contact with the second roller, a great current flows from the second roller, to which the high bias is applied, to the conductor of the drum via the defects of the film and thereby destroys the photoconductive layer. For this reason, the second roller should not be implemented by a conductor. Hence, the second roller has customarily been made of an insulator.

The insulative second roller causes charges to be released via the surface thereof due to natural discharge and conduction the toner. Generally, therefore, the surface potential Vm of the second roller is lower than the bias applied to the roller. It follows that a bias Vb applied to the second roller and implementing the preselected limit voltage Vk and saturation voltage Vh must be increased with an increase in the real resistance Rr of the roller. The real resistance Rr refers to the resistance between the bias electrode of the second roller and the surface of the same roller. However, the problem is that a high-tension power source capable of generating a high bias Vb is expensive. Moreover, this kind of power source must be accompanied by large-scale insulation equipment against the discharge from the high-tension section, and equipment against electric shocks. The resulting developing device is not feasible for common image forming apparatuses.

Figure 8:
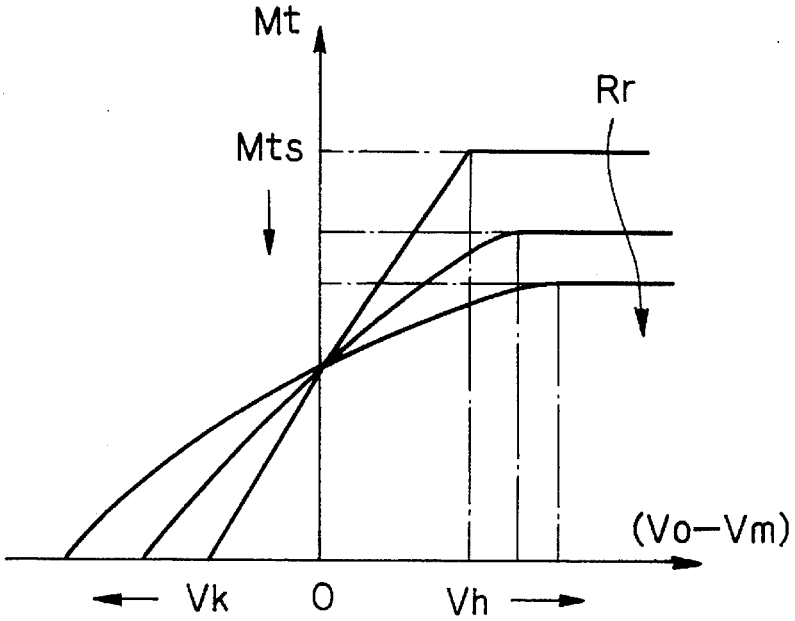
FIG. 8 shows a gamma characteristic determined by changing the real resistance of the second roller.
Figure 9:
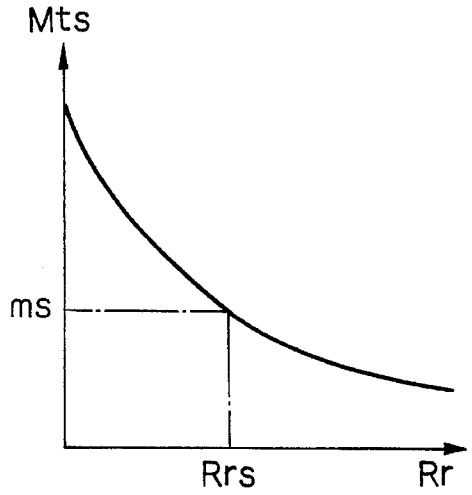
FIG. 9 shows a relation between the real resistance and a saturation amount of toner deposition.
Figure 10:
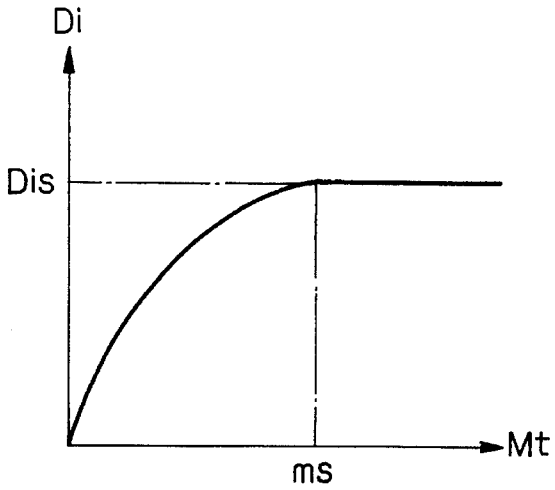
FIG. 10 shows a relation between the amount of toner deposition on a photoconductive element for a unit time and a unit area and the density of an image transferred to a paper.
Figure 11:
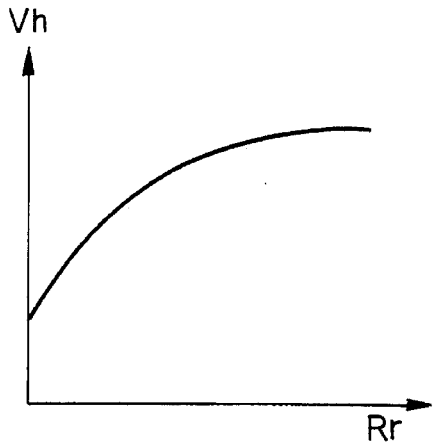
FIG. 11 shows a relation between the real resistance and the saturation voltage for development.

FIG. 8 indicates how the development gamma characteristic changes when the real resistance Rr of the second roller is changed. FIGS. 9 and 10 respectively show a relation between the real resistance Rr and the saturation amount of toner deposition Mts, and a relation between the amount of toner deposition Mt on the photoconductive element for a unit time and a unit area and the density Di of an image transferred to a paper. The relations shown in FIGS. 9 and 10 also occur when the real resistance Rr is changed. Further, FIG. 11 shows a relation between the real resistance Rr and the saturation voltage Vh. As indicated by an arrow in FIG. 8, when the real resistance increases, the gradient of the gamma characteristic decreases while the absolute values of saturation voltage Vh and limit voltage Vk increase (see FIG. 11).

Also, as FIGS. 8 and 9 indicate, the saturation amount of toner deposition Mts decreases with an increase in the real resistance Rr. As shown in FIG. 10, as the amount of toner Mt to deposit on the photoconductive element for a unit time and a unit area increases, the density Di of an image on a paper increases. However, when the amount of toner Mt exceeds a saturation amount ms which gives a saturation density Dis, the density Di remains at the saturation or maximum density Dis. In practice, a gamma characteristic curve is selected such that the saturation amount of deposition Mts gives the saturation density Dis. However, when the real resistance Rr is extremely high, the saturation amount Mts decreases to below the saturation amount ms giving the saturation density Dis, as shown in FIG. 9. As a result, the difference between the gray levels of an image decreases, preventing the image from appearing clear-cut. It follows that the real resistance Rr should not be increased to an excessive degree.

The second roller may have major part thereof implemented by a semiconductive material in order to eliminate the problem discussed above. A foam resin material in which a powdery conductive material is dispersed is conventional as a semiconductive material. However, it is difficult to produce a foam resin material having a predetermined resistance coefficient by controlling the dispersion of the conductive material. Moreover, the resistance locally changes in this kind of foam resin material. Hence, the second roller made of this kind of material is partly or entirely irregular in resistance. Toner images produced by such a second roller suffer from irregular density distributions, background contamination, and other defects.

Figure 2:
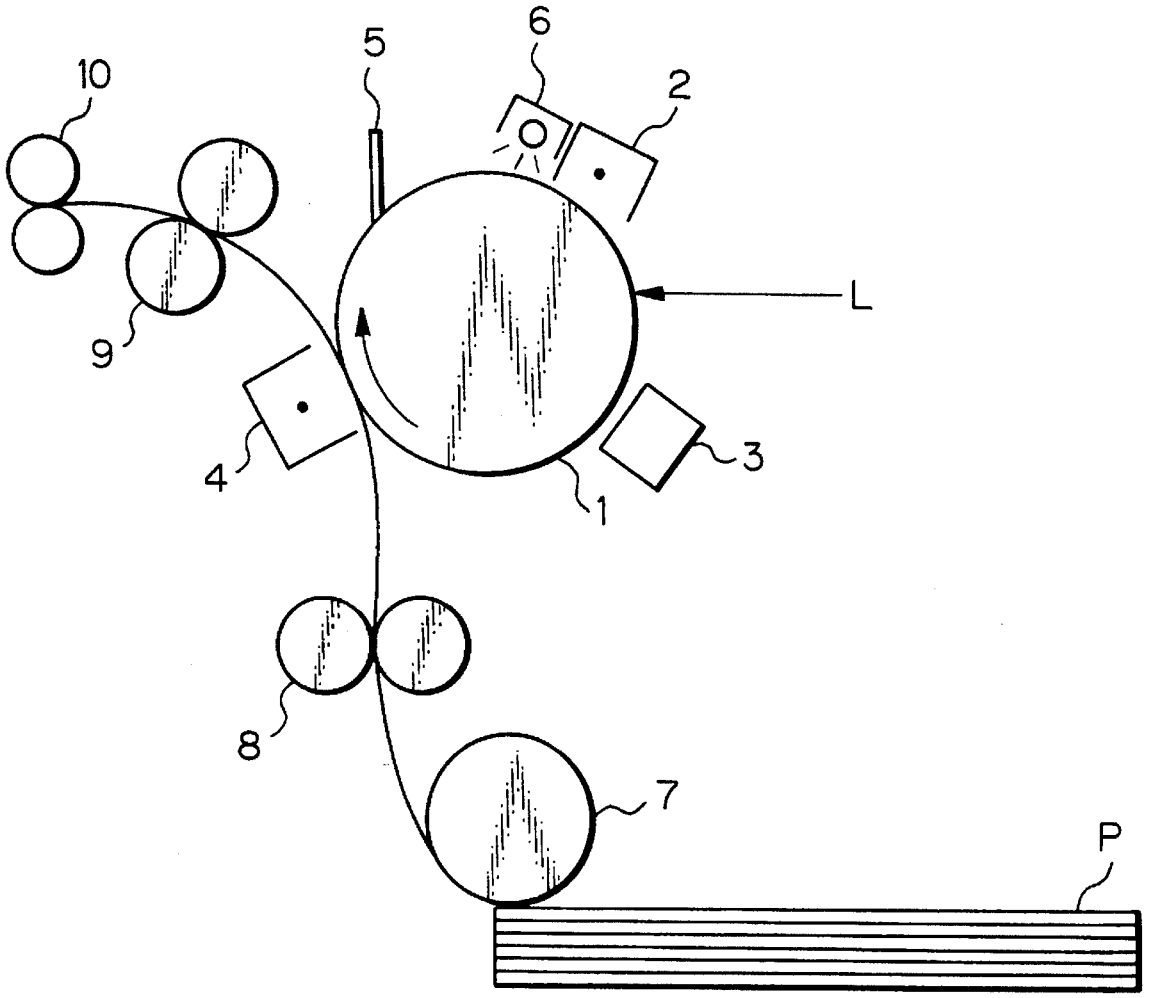
FIG. 2 is a section of a copier having the developing device shown in FIG. 1.

Referring to FIG. 2, an image forming apparatus with a developing device embodying the present invention is shown and implemented as a copier by way of example. As shown, the copier has a photoconductive drum 1 rotatable clockwise, as indicated by an arrow in the figure. While the drum 1 is in rotation, a charger 2 uniformly charges the surface of the drum 1. The charged surface of the drum 1 is exposed imagewise by light L with the result that a latent image is formed thereon in accordance with the intensity of the light L. The latent image is developed by a developing device 3 to turn out a corresponding toner image. The toner image is brought to an image transfer unit 4. A paper P is driven out of a cassette toward a registration roller pair 8 by a pick-up roller 7. The roller pair 8 conveys the paper P toward the image transfer unit 4 in synchronism with the toner image being conveyed by the drum 1. The transfer unit 4 transfers the toner image from the drum 1 to the paper P. The toner image on the paper P is fixed by a fixing unit 9. Finally, the paper P with the fixed toner image is driven out of the copier by a discharge roller pair 10 as a hard copy. After the image transfer, the toner remaining on the drum 1 is removed by a cleaning blade 5. Subsequently, the charge remaining on the drum 1 is dissipated by a discharger 6.

Figure 1:
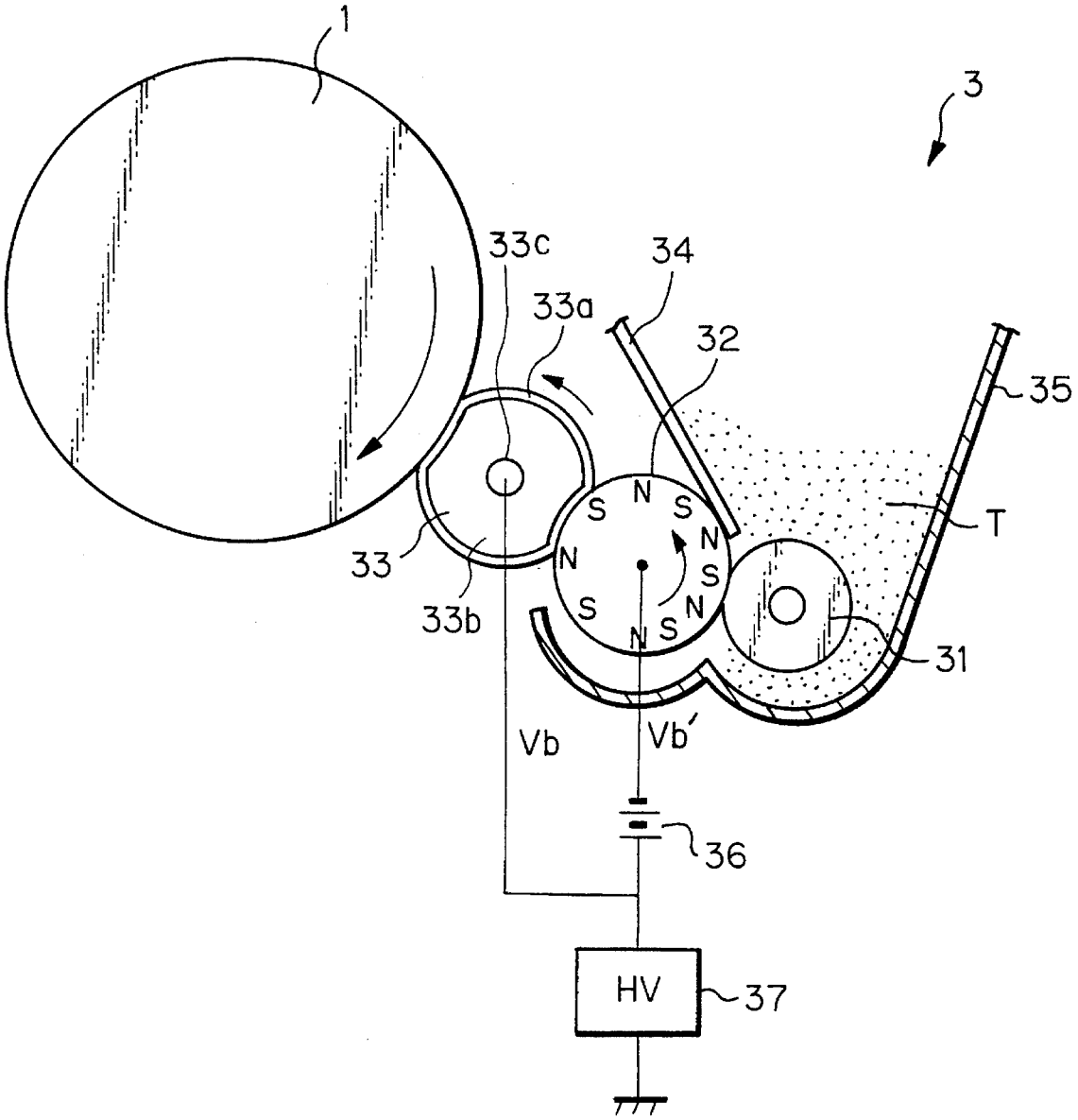
FIG. 1 is a section of a developing device embodying the present invention.

FIG. 1 shows the developing device 3 in detail. As shown, the device 3 has a first developing roller 32 and a second developing roller 33. The second roller 33 is made of an elastic material and made tip of two layers. The second roller 33 is held in contact with the drum 1 and moved in the same direction as the drum 1, as seen at the contacting position. The first roller 32 is made of a material harder than the material of the second roller 33 and is provided with fine N-S magnetic poles on the surface thereof. The first roller 32 is held in contact with the second roller 33 and moved in the opposite direction to the roller 33, as seen at the contacting position. A supply roller 31 is positioned below a hopper 35 storing toner T therein. The supply roller 31 feeds the T toward the first roller 32. The toner T is magnetically deposited on the first roller 32 and conveyed toward the drum 1 thereby. A blade 34 regulates the amount of toner T being conveyed by the first roller 32. The second roller 33 is elastically deformed to form a nip portion having a predetermined area between it and the drum 1 and between it and the first roller 32. A negative bias is applied to each of the rollers 31 and 32. A bias power source (HV) 37 applies the voltage (bias) Vb of the negative terminal thereof. A bias voltage Vb', consisting of the bias voltage Vb and a negative bias voltage superposed thereon by a DC power source 36, is applied to the roller 32.

Figure 3:
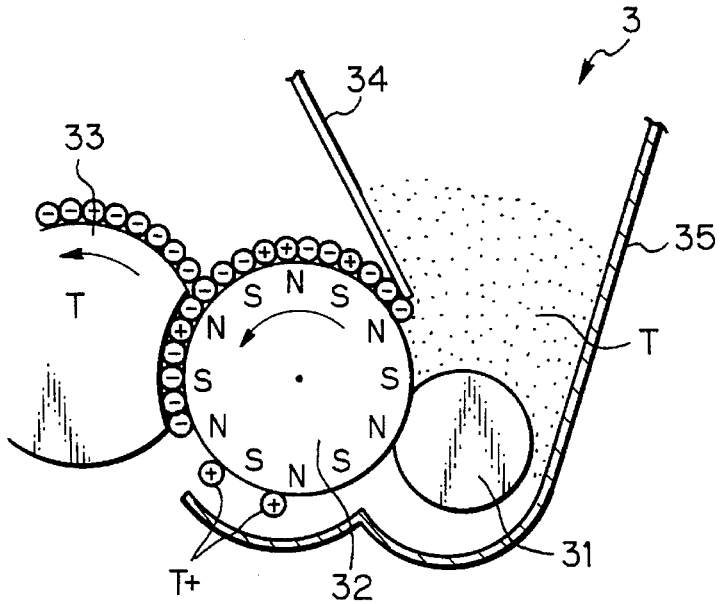
FIG. 3 is a fragmentary enlarged view of the developing device, demonstrating the conveyance of toner.

How the toner T is conveyed in the device 3 is illustrated in FIG. 3. As shown, the toner T, not accompanied by carrier, is driven toward the first roller 32 by the supply roller 31. Then, the toner T is conveyed to the position where the first roller 32 and blade 34 contact each other. The toner T is charged to negative polarity by being rubbed against the blade 34. The charged toner T is brought to the second roller 33 and transferred to the roller 33 by a potential difference between the rollers 32 and 33. The second roller 33 conveys the toner T to a developing position where it contacts the drum 1. Among the toner particles deposited on the roller 32, the particles T+ charged to the opposite polarity, i.e., to positive polarity are not transferred to the roller 33 due to the high negative bias applied to the roller 32. As a result, only the negatively charged toner T is brought to the developing position by the roller 33. The foregoing description has concentrated on negative-to-positive development. In the case of positive-to-positive development, the biases Vb' and Vb applied to the rollers 32 and 33, respectively, will be positive biases and will have a relation of Vb'<Vb.

As shown in FIG. 1, the second roller 33 is made up of a metallic core 33*c*, an elastic layer 33*b* made of resin, sponge, solid rubber or similar material having a volume resistivity of about $10^4$ Ωcm and a thickness of about 5 mm, and an insulative surface layer 33*a* made of fluorine-contained resin, silicone resin or similar material having a volume resistivity of about $10^{12}$ Ωcm and a thickness of about 20 μm. When the roller 33 was pressed against the drum 1 and roller 32, it ate into them in amounts of about 0.2 mm and about 0.4 ram, respectively. The drum 1, roller 33 and roller 32 are held in a ratio of 1:1.1:3 as to the rotation speed.

Figure 4:
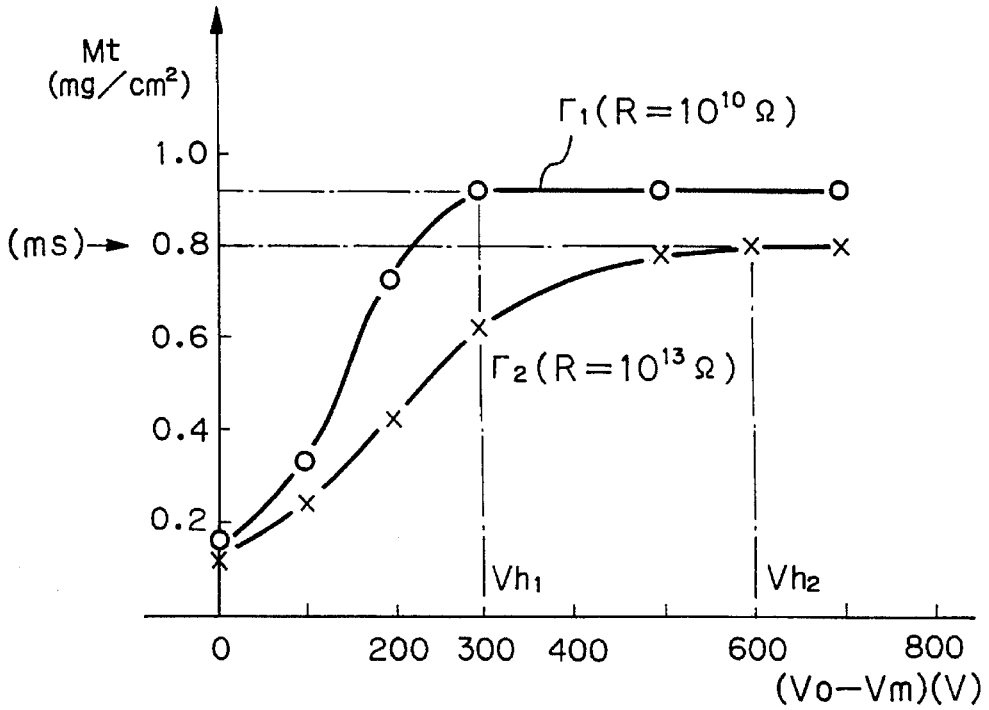
FIG. 4 shows a development gamma characteristic at normal temperature and determined by changing the real resistance of a second developing roller included in the embodiment.

FIG. 4 shows a development gamma characteristic determined at normal temperature by changing the thickness and material of the insulative surface layer 33*a*. Specifically, there are shown gamma characteristic curves $\Gamma_1$ and $\Gamma_2$ derived from real resistances Rr of $10^{10}$ Ω and $10^{13}$ Ω. As these curves indicate, saturation voltages $Vh_1$ and $Vh_2$ and saturation amounts of toner deposition $Mts_1$ and $Mts_2$ associated with the curves $\Gamma_1$ and $\Gamma_2$, respectively, are $vh_1$=300 V, $vh_2$=600 V, $Mts_1$=0.9 mg/cm$_2$, and $Mts_2$=0.8 mg/cm$_2$. It was found by experiments that the saturation amount of toner deposition ms at which the a m o u n t Mts gives the saturation density Dis is ms=$Mts_2$ =0.8 mg/cm$^2$. When the saturation voltage Vh exceeds 600 V, the bias power source 37 for applying the bias Vb to the second roller 33 sharply increases in size and cost and scales up the previously mentioned equipment against discharge and electric shocks. Therefore, the real resistance Rr should be lower than $10^{13}$ Ω, preferably lower than $10^{10}$ Ω. However, if the real resistance Rr is lower than $10^3$ Ω, the photoconductive layer of the dram begins to be destroyed, as stated earlier. In practice, therefore, the real resistance Rr should be higher than $10^3$ Ω but lower than $10^{13}$ Ω.

Figure 5:
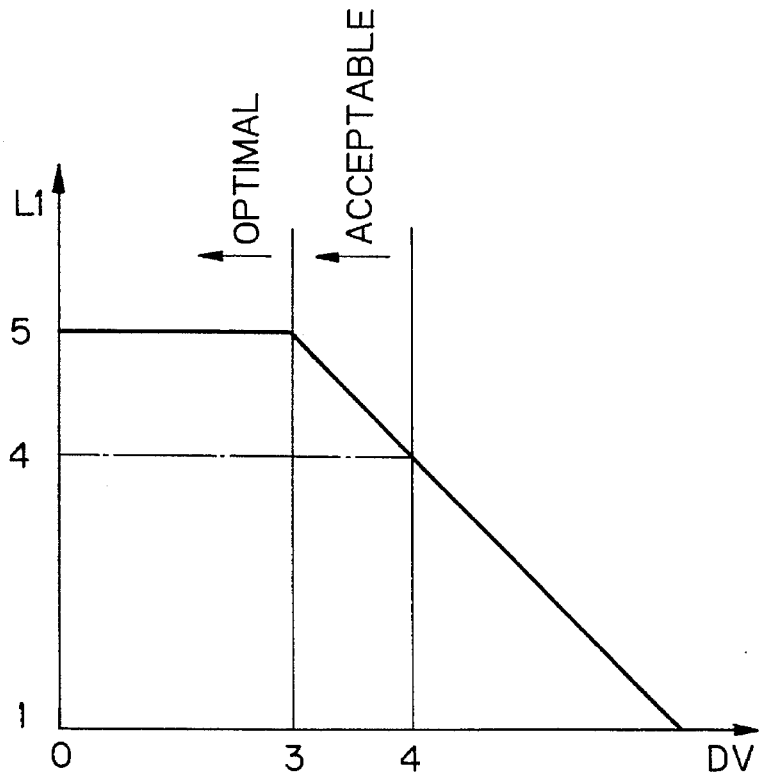
FIG. 5 shows the quality of recorded images estimated by changing the effective resistance.

FIG. 5 shows image quality estimated by changing the material of the elastic layer 33*b* of the second roller, i.e., the real resistance Rr thereof. In FIG. 5, the ordinate and abscissa respectively indicate the image level LI and the local deviation DV of the real resistance Rr. The local deviation DV is expressed as:

$$DV=[Log_{10}(Rr\ max/Rr\ ave)-Log_{10}(Rr\ min/Rr\ ave)]/2$$

where Rr ave denotes a mean real resistance, Rr max denotes the maximum real resistance, and Rr rain denotes the minimum real resistance. The image level LI was estimated in five ranks by comparing an actual image with a reference image by eye. The real resistance Rr sometimes locally deviates, depending on the material of the elastic layer 33*b*, as stated earlier. As shown in FIG. 5, so long as the local deviation DV of the resistance Rr is smaller than or equal to 4, the image level LI also remains higher or equal to 4 which is acceptable. In the roller 33 of the embodiment having the semiconductive elastic layer 33*b* and insulative surface layer 33*a* of great volume resistance, the real resistance Rr depends mainly on the surface layer 33*a*. Hence, all the local deviations DV of the roller 33 lie in the acceptable range shown in FIG. 5.

Because the major part of the second roller 22 is made of resin, sponge, solid rubber or similar material, the real resistance Rr of the roller 33 sometimes noticeably changes, depending on the temperature around the roller 33. Excessively low resistances Rr cause the background of a n image to be contaminated or destroy the insulation of the photoconductive element, as stated previously. Conversely, excessively high resistances Rr prevent dense clear-cut images from being produced.

Figure 6:
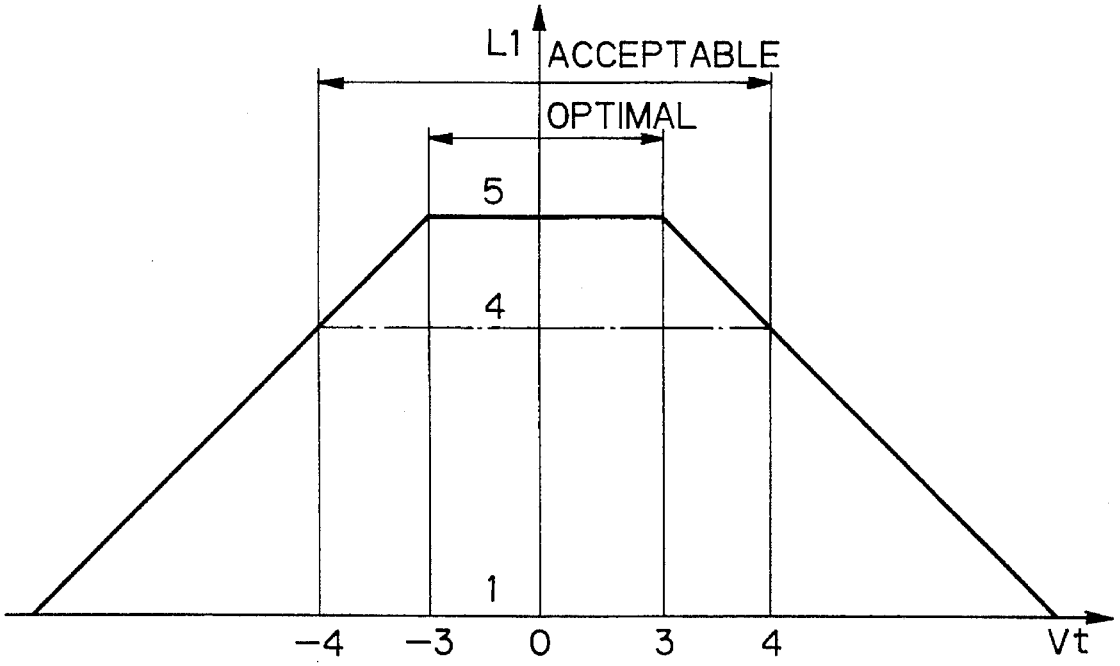
FIG. 6 shows the results of estimation of the dependency of the real resistance on temperature and the image quality.

FIG. 6 shows temperature variation ratios of the real resistance Rr and the quality of images estimated by changing the kind of the resin. In FIG. 6, the ordinate and abscissa indicate the temperature variation ratio Vt of the resistance Rr and the image level LI, respectively. The temperature variation ratio Vt is produced by:

$$Vt=Log_{10}(Rrt\ max/Rrt\ nor)$$

where Rrt max and Rrt nor respectively denote a real resistance derived from the maximum temperature change (5° C.≦t≦35° C.) and a real resistance at normal temperature.

As FIG. 6 indicates, to confine the image quality in the acceptable range, i.e., LI≧4, there should hold a relation of −4≦Vt≦4. It follows that the resin or rubber constituting the second roller 33 should satisfy the above relation, i.e., −4≦Vt≦4.

Figure 12:
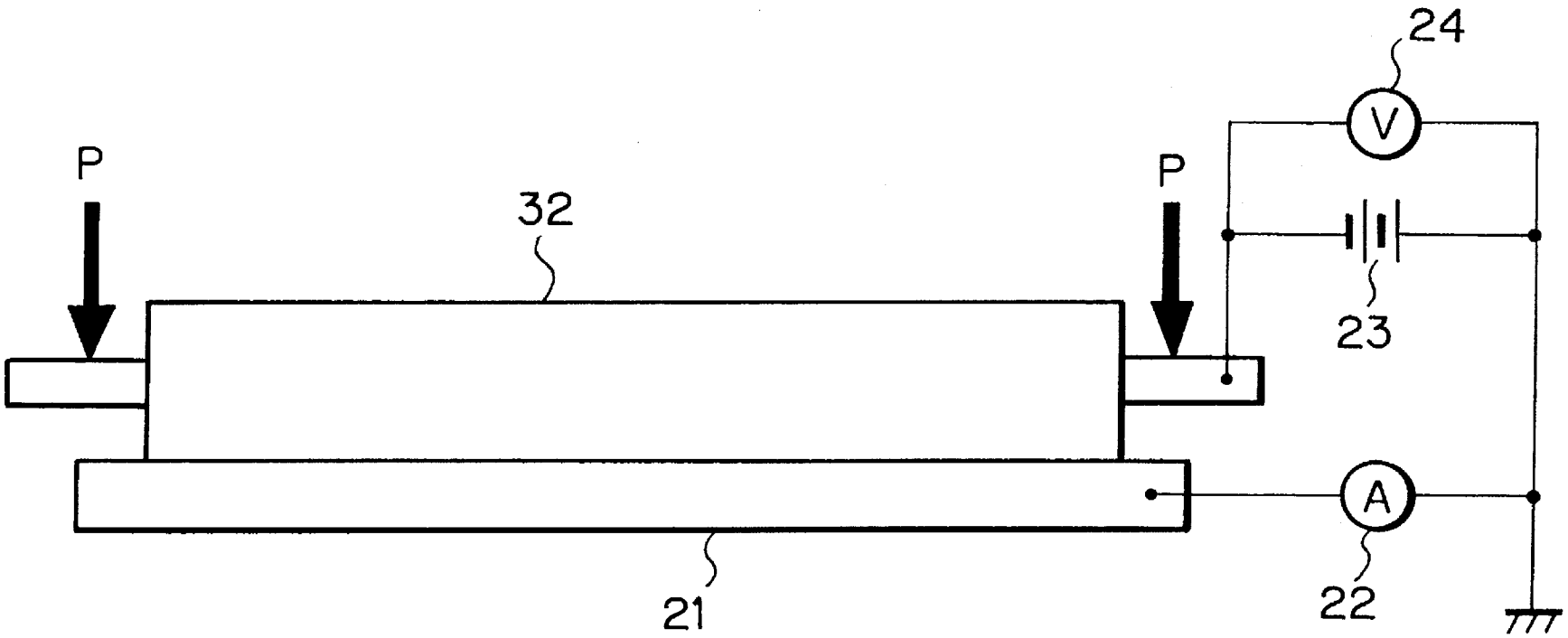
FIG. 12 shows a specific method of measuring the real resistance.

A specific method of measuring the real resistance Rr will be described with reference to FIG. 12. As shown, the roller 33 is pressed against a conductive plate 21 by a pressure P which is equal to the pressure to act in the actual assembly. A DC power source 23 is connected between the roller 33 and the conductive plate 21 via an ammeter 22. The output voltage E of the power source 23 corresponds to the bias Vb output from the bias power source 37. A voltmeter 24 is connected between the output terminals of the power source 23. In the illustrative embodiment, a plurality of second rollers 33 each having the elastic layer 33*b* made of a particular kind of resin or rubber were prepared. While each roller 33 was in rotation, a current flowing between the metallic core 33*c* and the conductive plate 21 was measured by the ammeter 22 in order to determine the local deviation DV of the real resistance Rr. The pressure P and voltage E were respectively set in a range of 0≦P≦5 kgf and a range of 0≦E≦5 kV. Assuming that the current measured by t h e ammeter 22 is I, the real resistance Rr can be produced by R=E/I, as well known in the art.

In summary, it will be seen that the present invention provides a developing device having various unprecedented advantages, as enumerated below.

(1) A second developing roller has an effective resistance of higher than $10^3$ Ω but lower than $10^{13}$ Ω between a bias application point and a surface layer thereof. Hence, a recorded image is free from an irregular density distribution and the contamination of its background and, therefore, clear-cut. This is achievable without resorting to an expensive high-tension power source or special equipment for insulation.

(2) The second roller has an insulative surface layer and a semiconductive elastic layer underlying the surface layer. Therefore, the irregularity of the second roller can be confined in a range ensuring high image quality.

(3) The logarithmic value of the ratio of the real resistance derived from the maximum temperature change to the real resistance at normal temperature and whose base is 10 is selected to be less than or equal to 4 in absolute value. Hence, images of high quality are achievable.

Various modifications will become possible for those skilled in the art after receiving the teachings of the present disclosure without departing from the scope thereof.

What is claimed is:

1. A developing device for developing a latent image electrostatically formed on an image carrier by toner, comprising:

a first developing roller made of a relatively hard material and formed with fine N-S magnetic poles on a periphery thereof, and for conveying the toner magnetically deposited on said periphery;

a blade contacting said first developing roller, and for regulating an amount of the toner being conveyed by said first developing roller, and for charging said toner being passed through between said blade and said first developing roller by friction;

a second developing roller made of a material softer than the material of said first developing roller and held in contact with said first developing roller, and for causing the toner adequately charged to be electrostatically transferred from said first developing roller to said second developing roller, and for conveying said toner to the image carrier; and a bias power source for applying a particular bias voltage to each of said first and second developing rollers;

wherein said second developing roller has a real resistance of higher than $10^3$ Ω but lower than $10^{13}$ Ω between a bias application point and a surface portion thereof.

2. A developing device as claimed in claim 1, wherein said second developing roller has an insulative surface layer and a semiconductive elastic layer underlying said insulative surface layer.

3. A developing device as claimed in claim 2, wherein a logarithmic value of a ratio of the real resistance between said bias application point and said surface layer and associated with a maximum temperature change to the real resistance at normal temperature and having 10 as a base is less than or equal to 4 in absolute value.

* * * * *